US007169027B2

(12) United States Patent
Jespersen

(10) Patent No.: US 7,169,027 B2
(45) Date of Patent: Jan. 30, 2007

(54) CYLINDRIC DRUM WITH REPLACEABLE GRINDING ELEMENTS

(76) Inventor: Poul Erik Jespersen, Lyngvænget 6, Glyngøre (DK) DK-7870

( * ) Notice: Subject to any disclaimer, the term of this patent is extended or adjusted under 35 U.S.C. 154(b) by 0 days.

(21) Appl. No.: 10/510,829

(22) PCT Filed: Apr. 10, 2003

(86) PCT No.: PCT/DK03/00238

§ 371 (c)(1),
(2), (4) Date: Nov. 2, 2004

(87) PCT Pub. No.: WO03/086710

PCT Pub. Date: Oct. 23, 2003

(65) Prior Publication Data

US 2005/0153638 A1 Jul. 14, 2005

(30) Foreign Application Priority Data

Apr. 13, 2002 (DK) ..... 2002 00551
Apr. 13, 2002 (DK) ..... 2002 00552

(51) Int. Cl.
*B24B 9/00* (2006.01)

(52) U.S. Cl. ..... 451/466; 451/468; 451/469

(58) Field of Classification Search ..... 451/464–469
See application file for complete search history.

(56) References Cited

U.S. PATENT DOCUMENTS 2,725,694 A 12/1955 Lukens
2,804,730 A 9/1957 Block
3,053,021 A * 9/1962 Block ..... 451/469
3,058,269 A * 10/1962 Block ..... 451/469
3,141,269 A * 7/1964 Block ..... 451/469
3,212,219 A * 10/1965 Gillett ..... 451/469
3,653,856 A * 4/1972 Field ..... 451/469
3,678,633 A * 7/1972 Block ..... 451/469
3,685,217 A * 8/1972 Belanger ..... 451/469
4,517,773 A * 5/1985 Heiden et al. ..... 451/466
4,872,792 A 10/1989 Block
4,882,879 A * 11/1989 Warner et al. ..... 451/469
4,980,996 A * 1/1991 Klink et al. ..... 451/51
5,155,945 A 10/1992 Tyler et al.
6,217,431 B1 * 4/2001 Brinkmann ..... 451/464

(Continued)

FOREIGN PATENT DOCUMENTS

DE 376094 5/1923

(Continued)

*Primary Examiner*—M. Rachuba
(74) *Attorney, Agent, or Firm*—James Creighton Wray

(57) ABSTRACT

A cylindrical drum has at its circumferential edge a number of recesses, each adapted for accommodating a replaceable grinding element including a retainer in which is mounted a sandpaper, support brushes and/or retainer brushes. The recesses in the cylindrical drum are made with side walls. The retainer is made with corresponding outer side walls. During use, by wedge action between the side walls of the recesses and the outer side walls of the retainer, a squeezing force on the side walls of the retainer directed in the circumferential direction arises. The retainer is designed with grooves for fastening at least one sandpaper, and the grooves extend from an upper side of the retainer and into the retainer for forming at least one elastic and pliable flap which is disposed between the grooves and at least one outer side wall.

14 Claims, 5 Drawing Sheets

U.S. PATENT DOCUMENTS

| | | | | |
|---|---|---|---|---|
| 6,592,442 | B2 * | 7/2003 | Hoffheimer | 451/466 |
| 2002/0086631 | A1 | 7/2002 | Hoffheimer | |

FOREIGN PATENT DOCUMENTS

| | | | |
|---|---|---|---|
| DE | 3342839 | | 6/1985 |
| DE | 29608280 | | 8/1996 |
| DK | 171364 | | 9/1996 |
| DK | 171703 | | 4/1997 |
| DK | 172548 | | 12/1998 |
| DK | 173094 | | 1/2000 |
| EP | 1201153 | | 5/2002 |
| JP | 361142078 | A * | 9/1986 |

* cited by examiner

CYLINDRIC DRUM WITH REPLACEABLE GRINDING ELEMENTS

This application claims the benefit of Danish Application No. 2002 00551 filed Apr. 13, 2002, Danish Application No. 2002 00552 filed Apr. 13, 2002, and PCT/DK03/00238 filed Apr. 10, 2003.

BACKGROUND OF THE INVENTION

The present invention relates to a cylindric drum provided at its circumferential edge with a number of recesses that each are adapted for accommodating a replaceable grinding element including a retainer means in which is mounted a sandpaper, support brushes and/or retainer brushes the recesses in the cylindric drum are made with side walls, that the retainer means are made with corresponding outer side walls and that by wedge action between the side walls of the recesses and the outer side walls of the retainer means a squeezing force on the side walls of the retainer means directed in the circumferential direction arises during use.

By surface treatment, as e.g. grinding or polishing of diverse elements, grinding and polishing tools are used which are designed with a cylindric drum in which is mounted grinding elements that include sandpaper, support brushes and/or retainer brushes.

Typically, these grinding elements are made in a plastic material in which sandpaper and brushes are often moulded. Experience shows that sandpaper and support brushes/retainer brushes are not worn with the same rate. This means waste of material as it is necessary to discard the entire grinding element, even though it is typically only the sandpaper which is worn out.

Since a circumferential edge of a cylindric drum as an average is provided with between 30 and 60 grinding elements with sandpaper and brushes that by industrial use of the grinding or polishing tool are to be replaced regularly, the amount of grinding elements discarded constitutes a problem.

Furthermore, the shape of the element that is desired ground and the control of the cylindric drum during grinding will imply uneven wear of the sandpaper on the cylindric drum so that some of the mounted grinding elements are to be replaced more often.

Different types of cylindric drums exist by which this problem is attempted solved by mounting grinding elements that may be dismounted, after which it is possible to replace sandpaper and/or brushes.

The disadvantage of the type of cylindric drums in which the grinding element is mounted replaceable in rails mounted on the circumferential edge of the cylindric drum is that the rails may damage the surface of an element desired to be ground, if the rails accidentally come into contact with the surface.

The disadvantage of the type of cylindric drums where sections of the grinding element is mounted in recesses and the fastening of the grinding paper to the block/moulding occurs outside the circumferential edge of the cylindric drum is that there is an increased risk of the fastening area of the grinding paper is subjected to unnecessary wear, and thereby the sandpaper is more easily struck/tom off the grinding element.

Common to both the above types is that for fastening both the grinding element to the cylindric drum and the sandpaper to the grinding element as well as securing sandpaper and/or brushes for the grinding element there is used e.g. glue, screws or the like mechanical parts, making difficult dismounting of the grinding element from the cylindric drum and the subsequent replacement of either sandpaper or brushes.

SUMMARY OF THE INVENTION

Therefore, it is the purpose of the present invention to indicate a cylindric drum with exchangeable grinding elements that are designed so that it is easy both to dismount the grinding element and subsequently to replace the sandpaper and/or brushes of the grinding element.

This is achieved with an apparatus as described in the preamble of claim 1, and wherein the retainer means are designed with grooves for fastening at least one sandpaper, and the grooves extending from an upper side of the retainer means and into the retainer means for forming at least one elastic and pliable flap which is disposed between grooves and at least one outer side wall.

In the following, there is described a cylindric drum used in connection with a grinding/polishing tool for surface treatment, but the invention may also be used in connection with other machine facilities and/or tools where it is desired easily and rapidly to replace sections, as for example:

a sweeping machine,
an automatic carwash,
the blade of an ice scraper,
the blade on a windscreen wiper, and
the rubber on a scraper.

The recesses in the circumferential edge of the cylindric drum are designed so that the retainer means of the grinding element is entirely accommodated in the cylindric drum. This means that there is no projecting sections of the retainer means which, if the cylindric drum is disposed too close to the surface of the element, may destroy the surface of the element that is surface treated.

Furthermore, the full accommodation of the retainer means in the recesses of the cylindric drum will protect the fastening area between the retainer means and the grinding paper/brush from wear and impact when the cylindric drum is rotating and the grinding elements are brought in connection with the surface of the element to be surface treated. This means that grinding paper and brushes are not so easily broken to pieces or torn out of the retainer means, and the service life of the grinding element is considerably increased.

In order to secure the retainer means of the grinding elements in the recesses, the recesses in the cylindric drum are designed with side walls and the retainer means of the grinding elements are made with corresponding outer side walls so that these fit together. The side walls of both recess and retainer means are made as non-parallel at an angle different from zero degrees.

The cross-sectional shape of the recesses with non-parallel side walls imply that the retainer means of the grinding element is either to be struck/wedged down into the recess or is to be longitudinally displaced into the recess.

In order that grinding paper and/or brushes can be retained in the retainer means of the grinding element, this is designed with a groove running from an upper side of the retainer means and into the retainer means for forming elastic and pliable flaps disposed as an outer edge of the groove. Sandpaper and/or brushes are placed in the groove between the flap and the rest of the retainer means.

In a retainer means there may be formed up to several flaps if e.g. it may be possible to replace both sandpaper and brushes.

Due to the cross-sectional shape with non-parallel side walls of both recess and retainer means, by mounting the retainer means in the recess there will be a wedge action between the side walls of the recesses and the outer side walls of the retainer means, which hold the grinding element in place in the recess in the first place.

In order to ensure that sandpaper and/or brushes of the grinding element are secured in the retainer means when the cylindric drum is rotated, either during use or by mounting more grinding elements in the cylindric drum, a squeezing force is to be applied in direction of the circumferential edge on the side walls of the retainer means, which thereby act on the elastic and pliable flaps formed in connection with the grooves for accommodating sandpaper and/or the brushes, so that the flaps are squeezing around sandpaper and/or brushes placed in the grooves in the retainer means.

The squeezing force may arise in different ways, and e.g.:

- the retainer means may be supersized compared with the opening, or
- both retainer means and recess may be designed with corresponding retainer means, or
- the side walls of the recesses may be designed so that when the centrifugal force will fling the retainer means outwards, the shape and mutual disposition of the side walls prevent this outwards directed movement of the retainer means.

When a grinding element is dismounted from a recess, the squeezing force on the outer side walls of the retainer means will fall away, and it will thus be possible to dismount sandpaper and/or brushes disposed in the grooves of the retainer means by bending the elastic flaps outwards in relation to the retainer means and subsequently place a new sandpaper or brush, after which the grinding element may be reused.

The cylindric drum may be of different width, where the recesses of the circumferential edge extend fully or partly over the entire length of the circumferential edge. The recesses will preferably be placed approximately in parallel with the rotational shaft of the cylindric drum.

An alternative is a recess winding around the circumferential edge from one end of the cylindric drum to the other end.

Typically, the recesses on a short cylindric drum will be designed as holes, whereas the recesses on a longer cylindric drum will be channels or a row of juxtaposed holes.

In situations where the retainer means are squeezed together by means of centrifugal force, it is necessary that the recesses are designed so that they have radially outwards tapering cross-sectional shape.

This means that the retainer means are to be mounted longitudinally displaceable in the recesses, whereby the opening section of the recess being smaller than the retainer means prevents the retainer means from leaving the recesses, typically during operation, by rotation of the cylindric drum.

In order for the retainer means to be mounted in the recess on a cylindric drum with a certain width, the retainer means are designed as mouldings, where each moulding is adapted for longitudinally displacing mounting in a recess.

This means that it is possible to fasten sandpaper to the moulding by simply placing a section of the sandpaper down in the groove on the moulding, after which a squeezing force will press the sides of the groove together and thereby squeeze around the sandpaper and retain it in the moulding.

In order to provide accommodation of the sandpaper in the moulding groove and simultaneously provide safety for the sandpaper being secured to the moulding, the groove in the moulding is made up of one or more sections, where a first section is a preferably straight groove and where a second section includes either a cavetto or a preferably straight groove which is connected at an angle in relation to the first section of the groove of the moulding.

In an embodiment of the invention, the groove in the moulding consists of a preferably straight groove, where the sandpaper is disposed so that the sandpaper is filling a substantial section of the groove, after which a squeezing force will press the sides of the moulding groove together and thereby squeeze around the sandpaper and hold it to the moulding.

In a second embodiment of the invention, the groove in the moulding consists of a first section, which is a straight section, and a second section, which is a cavetto, where the sandpaper is placed so that the lower section of the sandpaper extends through the first section of the groove and down into the cavetto.

In order to hold the sandpaper in place, the lower section of the sandpaper may be rolled up so that the roll is fitting the size of the cavetto. This thickening of the cross-section of the lower section of the sandpaper results in the lower section of the sandpaper having a larger cross-section than the width of the first section of the groove. This implies that the sandpaper is retained in the groove during an operation situation as well as during a stand-still situation.

In a third embodiment of the invention, the groove in the moulding consists of a first section, which is a straight section, and a second section, which is a straight section, and which are mutually connected at an angle.

The sandpaper is disposed so that the lower section of the sandpaper extends through the first section of the groove and into the second section of the groove. The turn-up of the lower section of the sandpaper at the transition of the first section of the groove and the second section of the groove implies that the sandpaper is retained in the groove during an operational situation as well as during a stand-still situation.

As it is the turn-up of the sandpaper between the first and second sections of the groove that is used as retainer, and the costs of sandpaper are minimal, it is not necessary for the sandpaper to extend right into the bottom of the second section of the groove.

Irrespectively of which of the above embodiments of the moulding used, it is important that the sandpaper is retained in the recess by means of a squeezing force acting on a part of the first section of the grinding groove.

The squeezing force is to be regarded as a tangential force that squeezes the flap of the moulding against the groove so that the first part of the groove is squeezed together, and which is attained either mechanically or by means of the centrifugal force.

Due to the radially outwards tapering cross-sectional shape and the corresponding shape of the moulding, a radially outwards directed pressure on the moulding will result in the moulding being wedged in the recess, and the wedging or squeezing force is produced in a part of the first section of the groove.

In an embodiment of the invention, the mouth of the first section of the groove on the upper side of the moulding is placed close to the outer edge of the upper side, so that a flexible and pliable flap between the groove and the outer side of the moulding is formed.

The sandpaper is thus disposed at one side of the moulding, and subsequently there is space for a number of brushes at the upper side.

In the embodiment of the invention where the groove in the moulding consists of a first part, which a straight section, and a second part, which is a straight section, and which are mutually connected at an angle, there will be produced a flap consisting of one of the outer sides of the moulding and a part of the bottom of the moulding. This flap will have a pivotal point at the bottom of the part of the groove, and a hinge action is achieved in this pivotal point, making it easy and rapid to mount/replace the sandpaper by bending the flap out from the rest of the moulding.

In an embodiment of the invention where the squeezing force is produced mechanically, the moulding and the groove in the moulding are thus designed that the moulding is adapted for mounting in a recess with a spring plate situated in a bottom part of the recess, where the spring plate in an active position exerts a radially outwards directed pressure on the moulding, whereby a squeezing force arises on at least a section of the first section of the groove.

The spring plate consists of an upper part and a lower part that may be mutually displaced. The upper and lower parts of the spring plate are designed as a corrugated plate with a number of elevations, where the upper and lower parts of the spring plate may be mutually displaced.

The spring plate has two positions attained by lateral displacement of either the upper part and/or the lower part:

- an active position, where the upper and lower parts of the spring plate are brought into a position where the elevations of the two parts are disposed opposite each other, whereby the height of the spring plate is increased and presses the moulding radially outwards,
- a passive position, where the upper and lower parts of the spring plate are brought into a position where the elevations of the two parts are disposed mutually displaced, whereby the height of the spring plate is reduced and the radially outwards directed force is reduced.

In the passive position it is possible to longitudinally displace and remove the moulding from the recess in the cylindric drum for replacing the sandpaper.

In a second embodiment of the invention, where the squeezing force is produced mechanically, the moulding and the recess are designed so that the moulding has a slight overmeasure compared with the recess.

The squeezing force arises by mounting the moulding in the recess, and is sustained all the time during which the moulding is mounted in the recess, resulting in that a certain force is to be used for mounting and dismounting the moulding in the recess.

The moulding is therefore to be made of elastic and relatively shape retaining material, which is not too soft as this is a drawback if the moulding is made of too soft material since this has the consequence it being difficult to mount a moulding with overmeasure.

In a third embodiment of the invention, where the squeezing force is produced mechanically, the moulding and the recess are designed so that in the bottom of each recess, either over the entire length of the recess or on parts of the recess, there is disposed an eccentric unit which by turning a nut or a screw provides exertion of a radially outwards directed pressure on the moulding.

This eccentric unit may e.g. either be coupled to a trigger for each recess or may be coupled to one common trigger so that all eccentric units in the recesses of the cylindric drum are released at a time.

In a fourth embodiment of the invention, where the squeezing force is produced by means of centrifugal force, the moulding and the recess are designed so that the moulding and the recess have a cross-sectional shape directly corresponding to each other, and where the recess has a radially outwards tapering cross-sectional shape.

During operation, the centrifugal force will exert a radially outwards directed force resulting in that the moulding is pressed together outwards in the recess, and a squeezing force is produced on a part of the first section of the groove which squeezes together and holds the sandpaper.

This method for producing the squeezing force may only be used in the embodiments of the moulding where the groove either allows a rolling up of the lower part of the sandpaper in a cavetto or a turn-up of the lower part of the sandpaper, so that a part of the sandpaper is situated in the second section of the groove.

In order to provide a squeezing force, the moulding is designed so that the moulding is made either in an extruded thermoplastic material or in a moulded and/or extruded metal alloy. The material has a certain flexibility and elasticity, so that the material allows deformation of the flaps of the moulding without breaking.

By extruding a moulding according to the invention, a further advantage will be achieved as material contraction cavities are avoided by extruding a moulding. Contraction cavity occurs when elements with surfaces of a certain size are made, as the cooling of the elements results in that the sides become concave.

It is a drawback in making mouldings according to the invention as the undesirable shape produced by contraction cavities may have the consequence that the moulding cannot be retained in the recess of the cylindric drum. Furthermore, producing grooves in the moulding for accommodating sandpaper and/or brushes will imply a reduction in material consumption and reduce the risk of contraction cavity.

In an embodiment of the invention, the moulding is formed of one or more rows of brushes, preferably 2–4 rows, where the rows are mutually displaced. This displacement of the moulding implies that the moulding can be made with a less dimension, as the row displacement of the brushes imply that more rows of brushes can be placed on the same area than with common juxtaposed brush rows. The number of brushes furthermore significance to how good grinding/polishing the sandpaper is performing.

In a second embodiment of the invention, the groove in the moulding may be designed to accommodate sandpaper and a number of brushes. In order to improve the efficiency of the sandpaper, there may be mounted a number of support brushes in the same moulding groove. This ensures a close/good contact between sandpaper and a the first row of brushes. This implies that the groove is to be broader than if only the sandpaper is to be held, and that most probably a greater squeezing force is to be produced in order to hold both sandpaper and a number of brushes in the same groove.

In situations where the retainer means are secured by means of a fastening device, the retainer means are mounted in the grooves in the circumferential edge of the cylindric drum, and therefore it is necessary that the grooves are designed so that they have a radially inward tapering cross-sectional shape.

This has the consequence that the retainer means may be struck into the recesses, after which the corresponding fastening device engage and secures the retainer means in the recesses.

In order to provide a grinding element where it is possible to replace sandpaper and/or support brushes, the grinding elements include retainer means made as blocks, where each block is adapted for mounting in a recess that is designed as a hole at the circumferential edge of the cylindric drum, and that in each hole there is provided at least one retainer means that interacts releasably with at least one corresponding retainer means on at least one of the side walls of the blocks.

In this way it is possible to produce different versions of the cylindric drum which:

- includes both a cylindric drum and a number of grinding elements,
- includes a number of grinding elements for replacing worn grinding elements,
- includes a cylindric drum.

This means that the buyer has great flexibility with regard to costs for purchasing the different parts and the amount of waste formed by replacing grinding elements and/or cylindric drum.

The design of the holes of the cylindric drum on the circumferential edge as radially inwards tapering holes corresponding to the shape of a block of a grinding element means that it is simple to mount the different grinding elements in the holes. The mounting is affected by pressing a grinding element block down into one of the holes of the cylindric drum.

When all blocks of the grinding elements are placed in the holes of the cylindric drum on the circumferential edge, it will result in that the cylindric drum will appear as a solid unit where with no weak areas that may be deformed or broken during operation.

The fastening devices may be of a type allowing the grinding element block to be inserted in one of the holes of the cylindric drum under use of moderate pressing force, after which the grinding element block is secured.

This may e.g. occur by the grinding element block being made of a plastic material that during insertion in the grinding disc hole may yield slightly. This locking of the grinding element block in a hole is, however, to be surmounted by e.g. a mechanical release of the grinding elements.

The fastening device in the hole of the cylindric drum is to lock to or engage a complementary fastening device which is provided at the outer side of the grinding element block. These fastening devices, however, need not to be provided on all outer sides of the grinding element and on all side walls in the holes.

In an embodiment of the invention it may be sufficient to place one fastening device on one of the side walls in the holes of the cylindric drum that releasably engage one complementary fastening device on one of the outer sides of the block.

In order to accommodate a grinding element block in one of the cylindric drum holes, the radially inwards tapering holes on the circumferential edge of the cylindric drum may have one or more of the following shapes: cone/frustum of a cone, wedge/obelisk, pyramid/frustum of a pyramid, and/or prismatoid, and where a grinding element block may have one or more of the following corresponding shapes: cone/frustum of a cone, wedge/obelisk, pyramid/frustum of a pyramid, and/or prismatoid. The shape of the hole of the cylindric drum always corresponds to the shape of the grinding element block.

In an embodiment of the invention, the radially inwards tapering holes and the block of the grinding elements will be designed as obelisks, since it is simple in production to make block and hole with this shape. Furthermore, it will be easy to mount a grinding element in a hole as the block part of the grinding element may be designed so that it only may fit in a bole in one way. By means of the orientation of the sandpaper, it is easy to evaluate and place the grinding element correctly.

In a second embodiment of the invention where the holes and block parts, e.g., have a cone or frustum of cone shape, it may be more difficult to place a grinding element quite accurately.

In a further embodiment of the invention, where holes and block parts have shape as pyramid/frustum of pyramid or prismatoid, there may be achieved the same advantage as by an obelisk where the block part only may be mounted in a hole in a certain way, but the making of these grinding blocks themselves and the corresponding holes will be more difficult.

In order to readily replace the grinding elements of the cylindric drum, a lower part of each hole in the circumferential edge of the cylindric drum is connected with a channel that is preferably oriented in parallel with the rotary axis of the cylindric drum, and the bottom surface of the block is adapted to interact with a tool for releasing the fastening devices on the retainer means of the grinding element and in the hole.

This implies that in an embodiment of the invention it is possible to dismount the grinding element by means of a tool as e.g. a screwdriver. The screwdriver is inserted in the channel connected with the lower part of the hole, after which the screwdriver it tilted and exerts an outward pressure on the bottom surface of the block. The outwards pressure is so great that it overcomes the locking by the fastening devices of the grinding element block in the hole of the cylindric drum.

In a second embodiment of the invention, it is possible that in connection with each of the holes of the cylindric drum there is provided an eccentric unit which in a first position allow that the grinding element block is fastened/secured in a hole, and which in a second position may be turned so that it exerts an outwards directed pressure on the bottom surface of the block and thereby presses the block of the grinding element out of the hole.

These eccentric units may either be connected to one releasing unit activating and deactivating all eccentric units at a time or may be connected to a number of releasing units that are triggered individually for each of the holes.

In order to ensure that a grinding element is retained in one of the grinding disc holes when using the grinding arrangement, the fastening device is designed as one or more of the following: fluting/projections, cutout and/or locking groove/spring.

In an embodiment of the invention where the fastening device is a number of rounded flutes, the plastic material of which the grinding element block is made will allow the grinding element to be pressed down into the hole, after which the flutes, which are disposed staggered at one or more of the side walls in the hole and at the outer side of the grinding element block, engage and thereby prevent the grinding element from falling out during operation.

In a second embodiment of the invention there may be used recesses which e.g. have shape as small pointed triangles disposed so that they by pressing down of the grinding element block allow that the side wall of a hole and the outer side of a block easily slide past each other, and the block slides to the bottom of the hole after which the smallest side piece of the corresponding pointed triangles engage each other and secure the block in the hole.

In a third embodiment of the invention there may be cutouts in either the block or the hole and a corresponding projection on the complementary part providing that these engage and prevent the block from falling out In a fourth embodiment of the invention, there may be a spring device on the block itself, which, when being pressed down into the hole, will engage a locking groove and thereby retain the block in the hole during operation.

In order to secure a sandpaper and a brush to the block of a grinding element, there is provided means for accommodating sandpaper and/or brushes on the block.

The means for accommodating grinding paper may e.g. be grooves provided at a certain depth in the grinding element block, so that there is place for pressing a sandpaper down into the groove.

The groove may either be through-going from side to side so that one may mount the sandpaper laterally in the block, or may be designed so that the opening only extend from one of the sides and a length inwards, whereby the sandpaper may only be mounted from one side.

The mounted sandpaper may either have the same width as the groove, or may have a design so that the sandpaper is designed with a lower part having a certain width fitting to the groove width and which is less than the width of the block.

The part of the sandpaper not being secured in the groove may have a width that is either equal to the groove width, equal to the block width, or greater than the block width.

Which type to be chosen may e.g. depend on the element that is to be polished/ground or the desired efficiency of the surface treatment.

By mounting a support brush or a retainer brush in a grinding element block, the means for mounting may be a hole that either may have an inwards directed shape as the block itself or only be a cylindric hole into which it is possible to press a part of the brush down. Securing may thus be effected by e.g. gluing of the brush down into the hole.

An alternative means for accommodating the brush in the block may be a combination of a groove and a hole, where the brush may be pressed down into the hole by forcing the block apart around the groove, where the groove subsequently squeezes around the lower part of the brush mounted in the hole.

In order to ensure that sandpaper and brushes are sitting firmly in the grinding element the grinding element is designed so that the groove for accommodating the sandpaper has one or more flutes in the side faces, and that the hole for accommodating the brushes has one or more flutes in the surface.

In an embodiment of the invention, where the sandpaper is retained in a groove, it will be possible to provide a number of flutes in the side faces of the groove, where two opposite flutes are displaced so that the grinding paper will be secured between these flutes. Typically, there will be spacing between the tops of the flutes of between twice the sandpaper widths.

This implies that the sandpaper may easily be mounted in the block, and when the block is pressed into a hole, the shape of block and hole with two complementary fastening devices will produce a pressure at the side of the block so that the groove for the sandpaper is pressed together. The flutes will thereby press together around the lower part of the sandpaper and secure the latter during use.

The same may occur at the hole for accommodating the brush. Instead of possibly gluing the brushes down into the hole, these may be mounted in a hole with one or more flutes in the surface, so that the bottom part in which the brushes are mounted will come under the lowermost set of flutes in all cases, implying that they cannot automatically drop out during operation. If there are several sets of fluting upwards, these may go in and secure around the part of the brushes inside the foot of the grinding element.

An alternative to the describe means that may be used for fastening grinding paper to a block consist of designing a grinding element block with a recess at the outer edge of the grinding element, so that the grinding element by mounting in the hole of the cylindric drum will be applied a piece of sandpaper at the outer edge lying in the recess, and which by mounting of the block in the hole of the grinding disc will be secured.

Irrespectively whether the retainer means of the grinding elements is a block or a moulding, this may be provided with separate grooves for accommodating sandpaper and brushes, so that it is possible to replace either sandpaper or brushes of a grinding element when this has been dismounted from the cylindric drum.

In the embodiment of the invention where the retainer means is a moulding, the groove in the moulding will be longitudinal, so that one sandpaper or a number of sandpaper may be placed at once in the full length of the moulding.

The invention is explained more closely in the following with reference to the drawings, where:

DETAILED DESCRIPTION OF THE PREFERRED EMBODIMENTS

Figure 1:
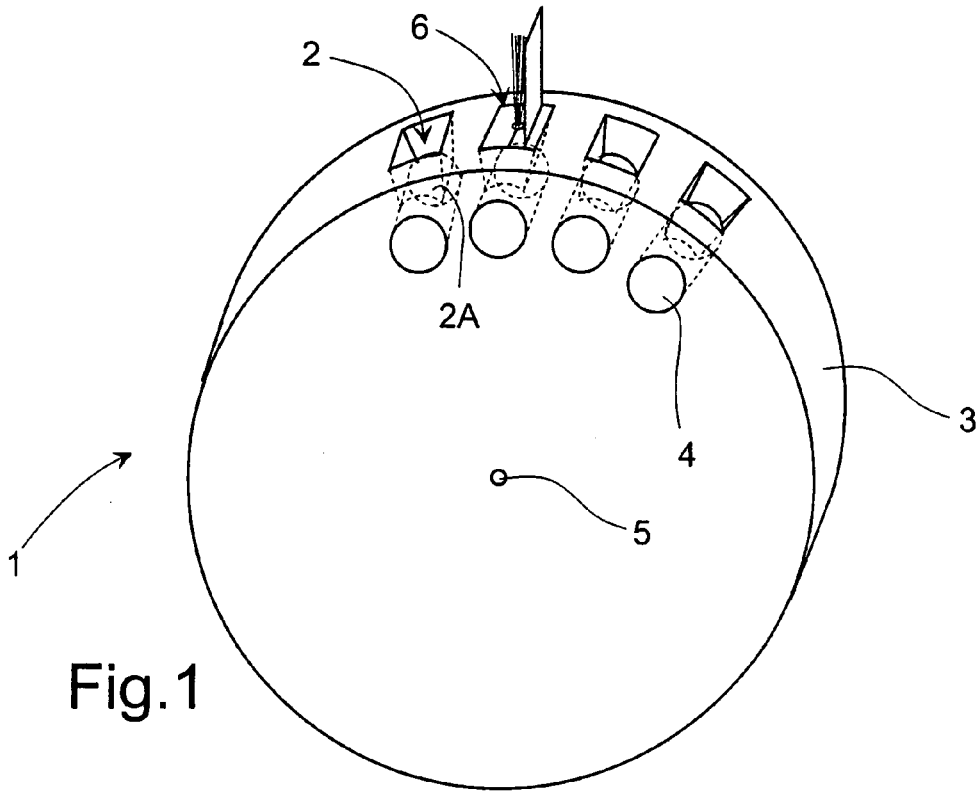
FIG. 1 shows a perspective view of a cylindric drum according to the invention.

On FIG. 1 is shown a cylindric drum 1 which is provided with a number of evenly distributed holes 2 along a circumferential edge 3, where each hole 2 is adapted for accommodating a grinding element 6.

The lower part 2A of hole 2 connects to a channel 4 which is preferably parallel with the axis of rotation 5 of the cylindric drum 1. These holes 2 are used for releasing the retainer means (not shown) of the grinding elements 6.

Figure 2:
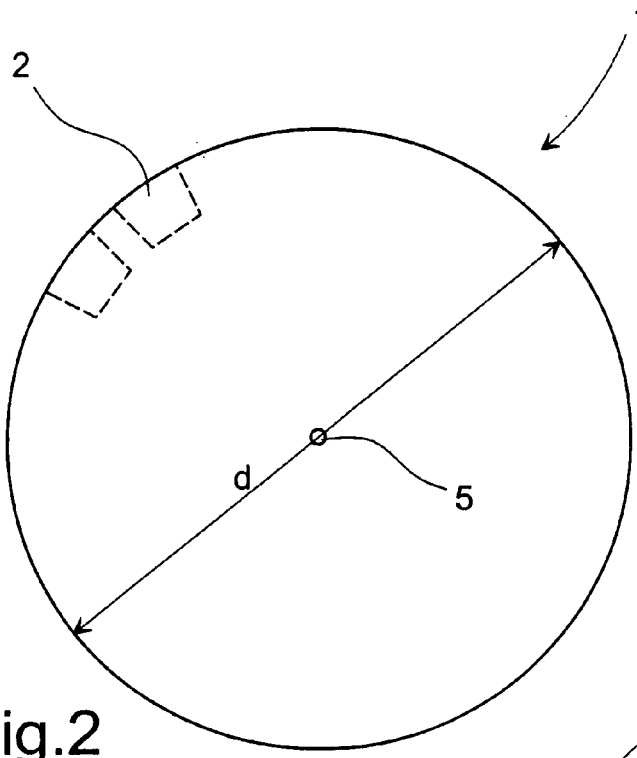
FIG. 2 shows a plan view of the cylindric drum in FIG. 1.

On FIG. 2 is shown a cylindric drum 1 having a diameter d of about 60 mm–200 mm.

Furthermore, the different outlines of some of the evenly distributed holes 2 are seen.

Figure 3:
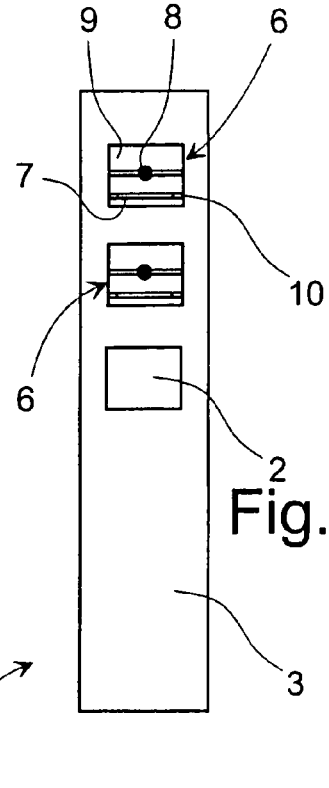
FIG. 3 shows a side view of the cylindric drum in FIG. 1.

On FIG. 3 is shown a cylindric drum 1 where half of the circumferential edge 3 is seen.

The grinding elements 6 are mounted in holes 3 on the circumferential edge 3 of the cylindric drum 1.

The grinding elements 6 include a sandpaper 7, a support brush 8, and a retainer means in the shape of a block 9.

The grinding elements 6 are designed so that alternating in the direction of the circumferential edge 3 there are provided a sandpaper 7 and a brush 8.

Figure 4:
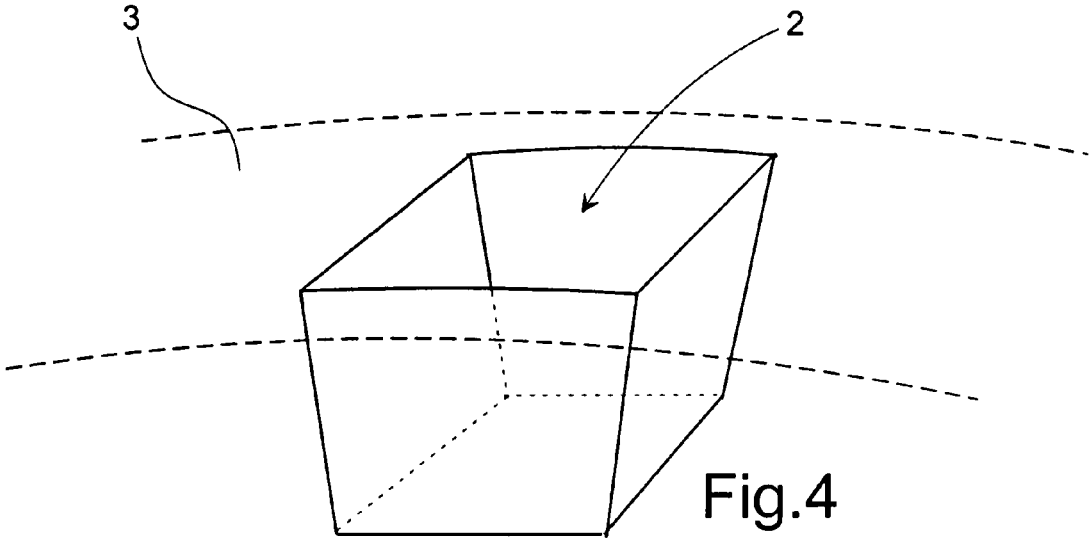
FIG. 4 shows a close-up view of a hole in the circumferential edge of the cylindric drum in FIG. 1.

On FIG. 4 is seen an embodiment of a hole 2 with shape as an obelisk for accommodating a retainer means in the shape of a block (not shown).

Figure 5:
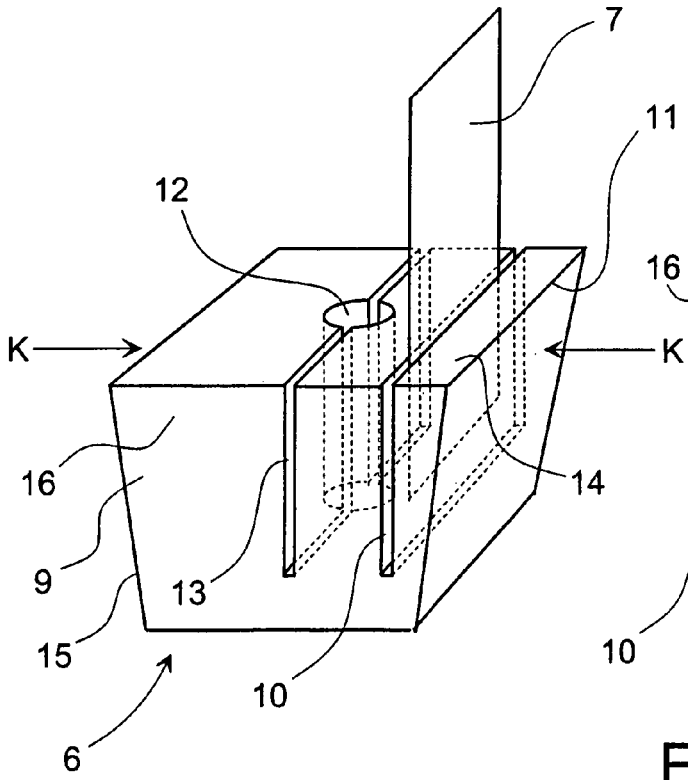
FIG. 5 shows a perspective view of a grinding element according to the invention.

On FIG. 5 is seen a grinding element 6 that include a retainer means in the shape of a block 9 that correspond to the shape of hole 2 in FIG. 4.

Block 9 has a transverse groove 10 disposed close to one outer side wall 11 of the block 9.

Groove 10 and outer side wall 11 of the block 9 form an elastic and pliable flap 14 allowing a squeezing force K on the side walls 11, 15 of the outer side of the block 9 which clamp sandpaper 7 in groove 10.

At the side of groove 10, block 9 is provided with a hole 12 for accommodating a brush (not shown), which e.g. may be either a support brush or a retainer brush.

In connection with hole 12 there is a through-going groove 13 which, together with side wall 15 of the outer side of the block 9, form a second elastic and pliable flap 16 allowing the squeezing force K on the side walls 11, 15 of the outer side of the block 9 clamping a brush (not shown) in hole 12.

Figure 6:
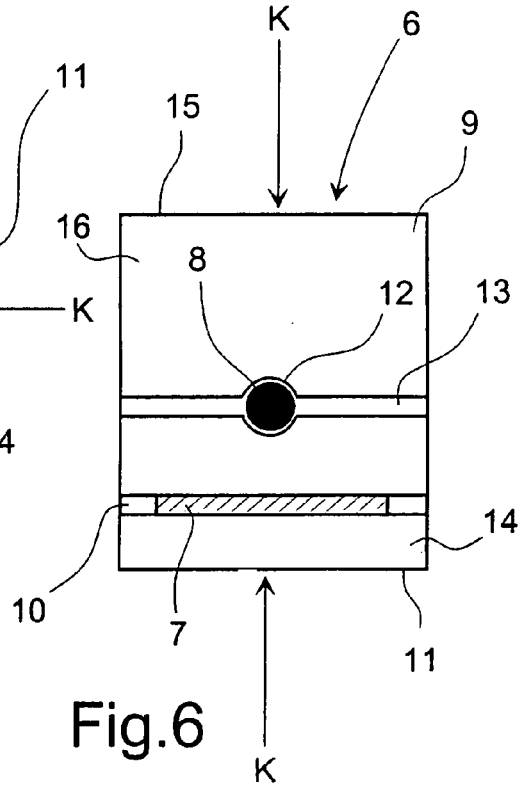
FIG. 6 shows a plan view of the grinding element in FIG. 5.

On FIG. 6 is shown a grinding element 6 where in the block 9 there is mounted a sandpaper 7 in groove 10 and a support brush 8 in hole 12/groove 13.

Groove 10 is through-going from side to side of the block 9, enabling mounting of the sandpaper 7 from both sides of the block 9.

Figure 7:
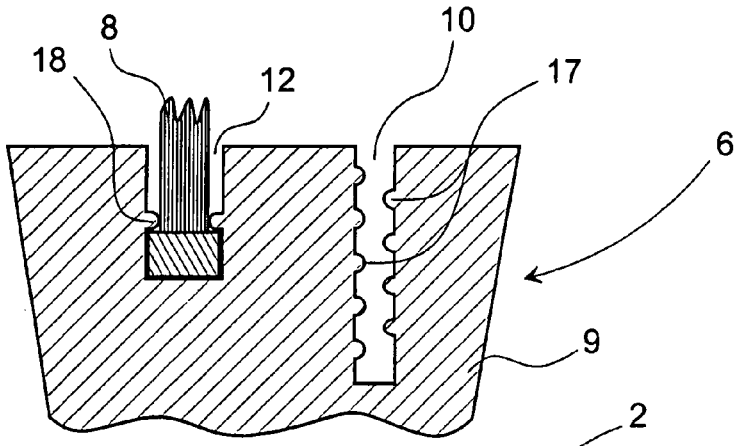
FIG. 7 shows a detail of a cross-section of a block according to the invention.

On FIG. 7 is shown a detail of a cross-section of a block 9, where the groove 10 for accommodating the sandpaper (not shown) has fluting 14 on both side walls of the groove 10. In hole 12 is used fluting 18 for keeping the support brush 8 down in the hole 12.

Figure 8:
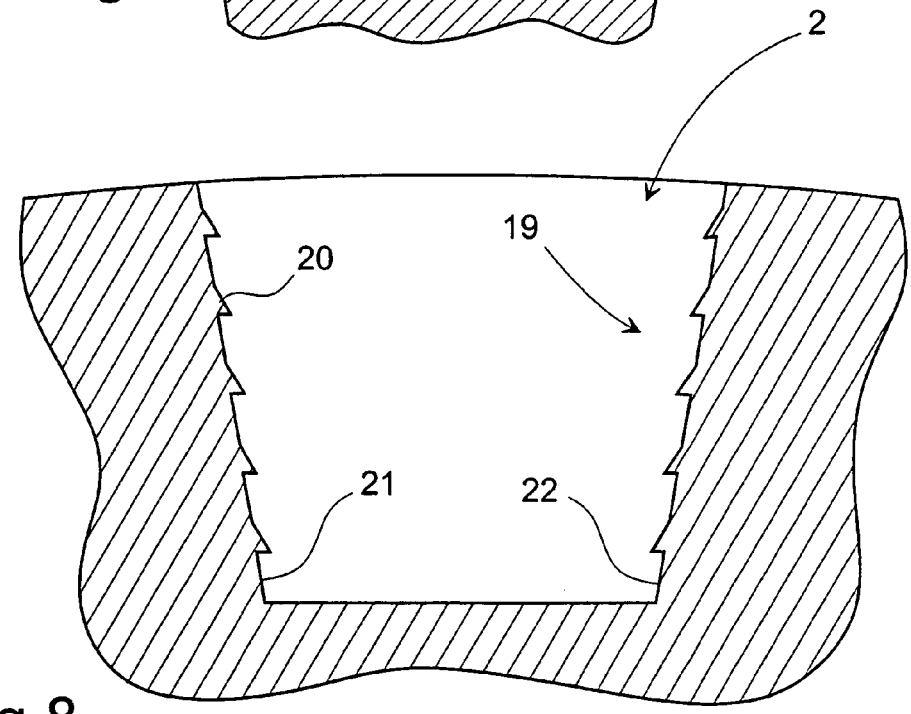
FIG. 8 shows a cross-section of a hole in the cylindric drum in FIG. 1.

On FIG. 8 is seen a hole 2 with fastening device 19, where the fastening device 19 includes a number of downwards facing triangular projections 20 which are provided on two opposite side walls 21, 22 of the hole 2.

Figure 9:
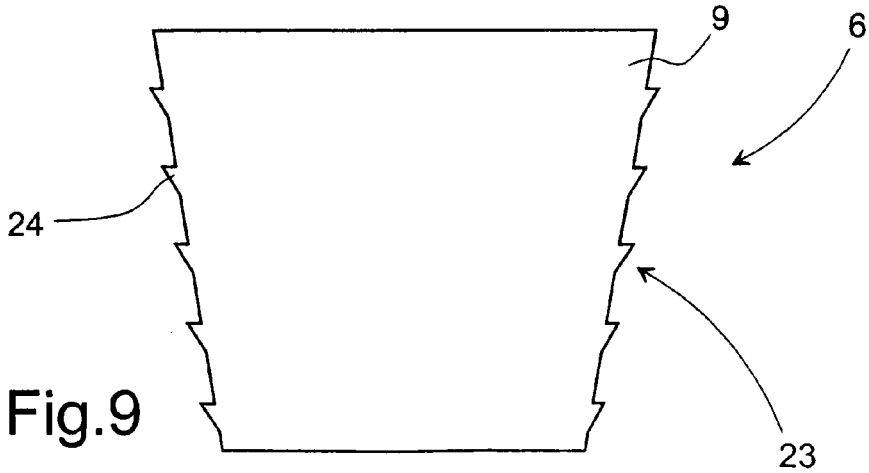
FIG. 9 shows a cross-section of corresponding retainer means for the hole in FIG. 8.

On FIG. 9 is seen a block 9 with a corresponding fastening device 23 in relation to fastening device 19 on side walls 21, 22 in hole 2 on FIG. 8.

Fastening device 23 has a number of upwards facing, triangular projections 24 which by placing block 9 in hole 2 will engage downwards facing, triangular projections 20 of the hole 2 and thereby secure the block 9 in hole 2.

Figure 10:
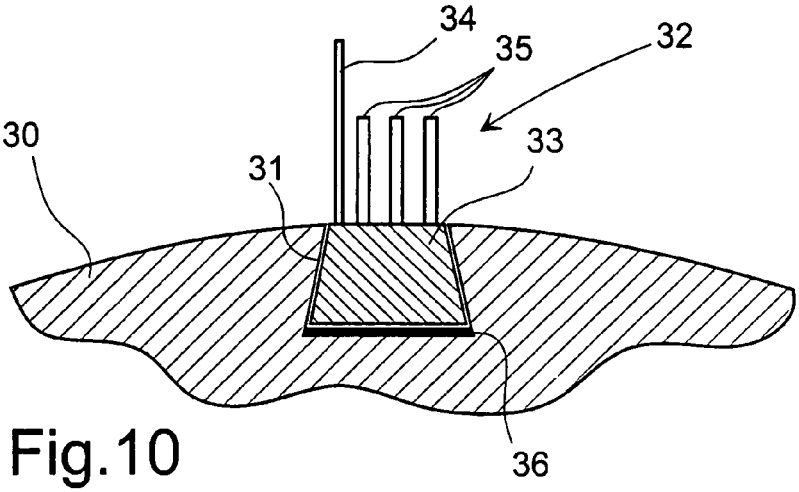
FIG. 10 shows a cross-section of a moulding mounted in a recess according to the invention.

On FIG. 10 is shown a detail of a cylindric drum 30 where in a groove 31 there is longitudinally displaceably mounted a grinding element 32 that include a retainer means in the shape of a moulding 33 in which is fastened a grinding paper 34 and number of support brushes 35.

The recess 31 has radially outwards tapering cross-sectional shape that correspond to the cross-sectional shape of the moulding 33 which is designed as a dovetail with straight sides. Between the list 33 and the bottom of recess 31 there is provided a spring plate 36.

Figure 11:
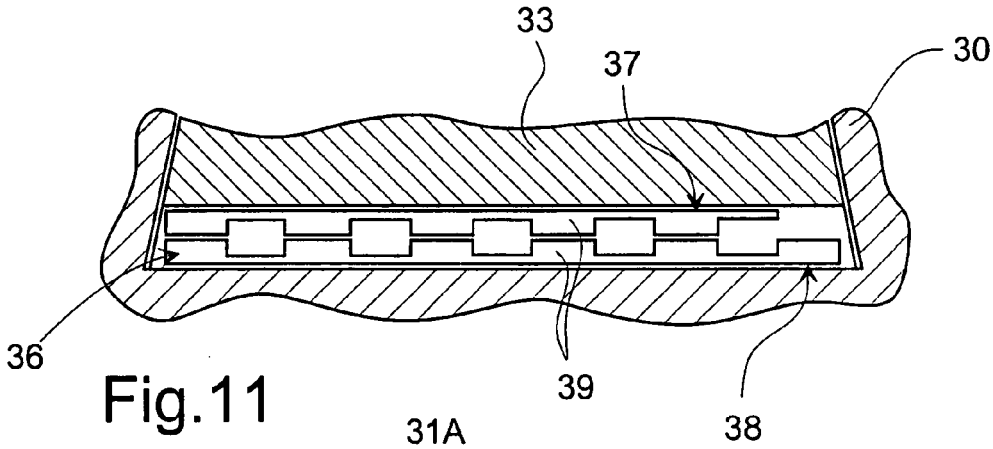
FIG. 11 shows a cross-section of a lower part of a recess.

On FIG. 11 is shown a spring plate 36 including two parts, an upper part 37 and a lower part 38, both having a number of elevations 39.

The spring plate 36 is shown in an active form, where the elevations 39 on the upper part 37 and the lower part 38 are disposed at positions opposite each other, whereby they are pressing the moulding 33 radially outwards.

By a transverse displacement of the upper part 37, the elevations 39 will fall into place with the elevations 39 in the lower part 38 and thereby remove the radially outwards directed force on the moulding 33.

Figure 12:
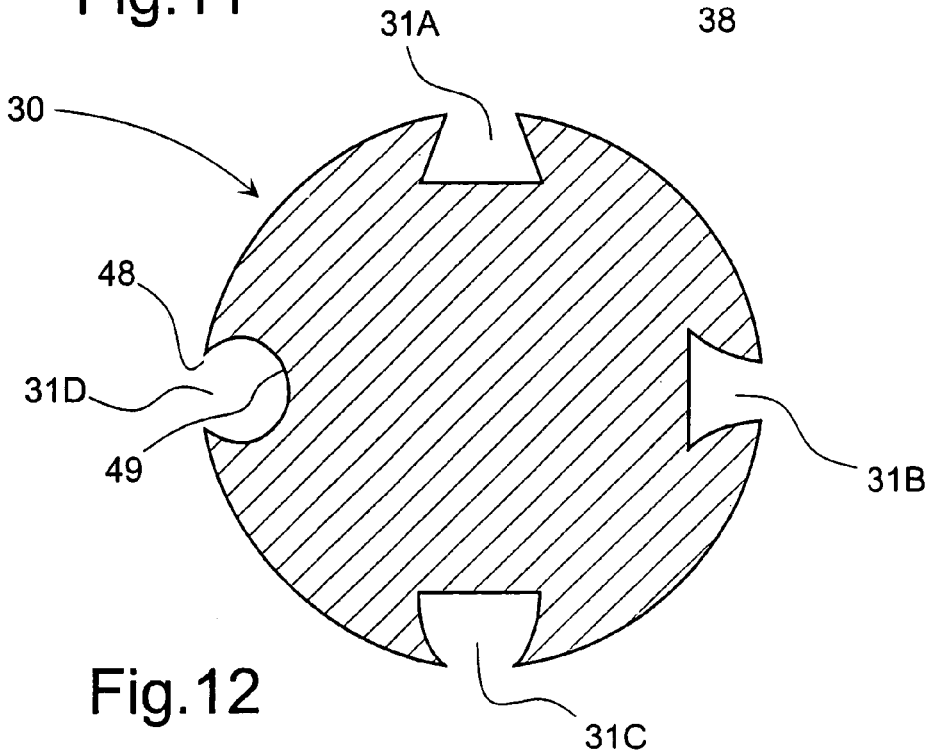
FIG. 12 shows a cross-section of an alternative recess shape.

On FIG. 12 there is shows a cross-section of a cylindric drum 30, where four different embodiments of recesses 31 are displayed.

The four embodiments of the recesses 31A, 31B, 31C, 31D all have in common that they entirely or partly have a radially outwards tapering cross-sectional shape, where:

recess 31A has straight sides with a mutual angle different from zero, recess 31B has concave sides, recess 33C has convex sides, and recess 33D has circular shape where the opening 48 is considerably smaller than the diameter of the circle 49.

Figure 13:
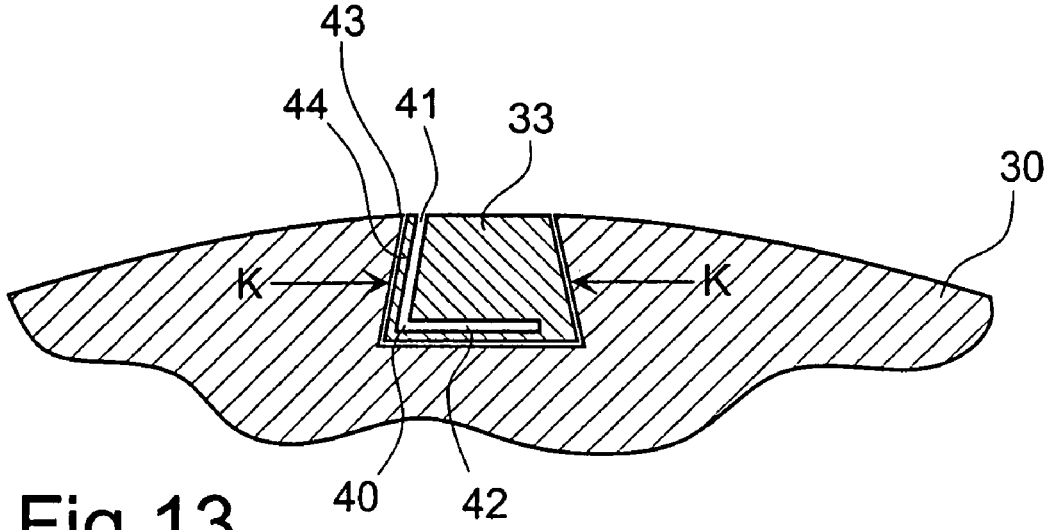
FIG. 13 shows a cross-section of an embodiment of a moulding according to the invention.

On FIG. 13 is shown a cylindric drum 30 mounted with a moulding 33 in which there is a groove 40 including a first part 41 which is connected with second part 42 of the groove 40 so that they form an angle.

The first part 41 of the groove 41 is disposed close to the side wall 43 of the moulding 33, whereby is formed an elastic and pliable flap 44 which will have pivotal point at the bottom of the second part 42 of the groove 40. This means that mounting/replacement of a grinding paper (not shown) may be performed easily and quickly.

If the moulding 33 is applied a squeezing force K, flap 44 will squeeze around the part of the sandpaper (not shown) which is disposed in the first part 41 of the groove 40 and partly in the second part 42 of the groove 40, whereby the sandpaper (not shown) is secured in the groove 40.

Figure 14:
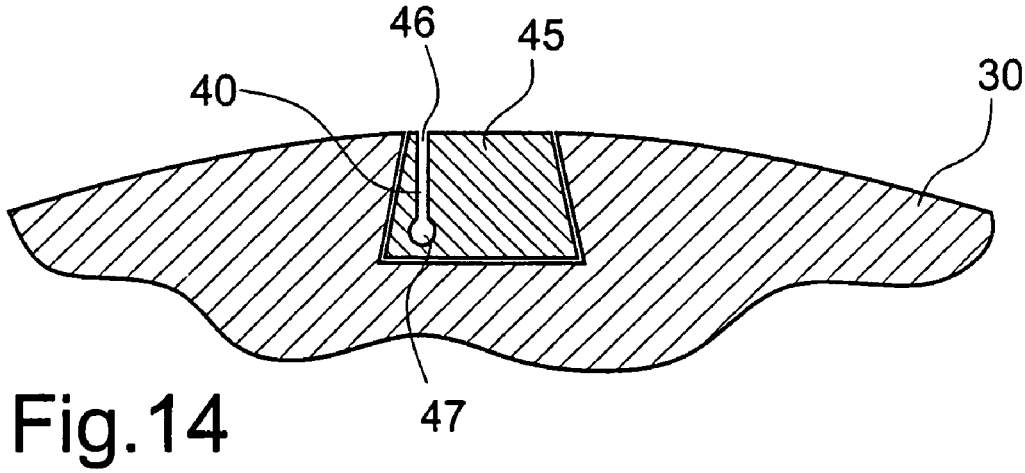
FIG. 14 shows cross-section of a second embodiment of a moulding according to the invention.

On FIG. 14 is shown a moulding 45 where the first part of groove 40 is a preferably straight groove 46 which is connected with a cavetto 47.

Thereby, it is possible to bend the lower part of a sandpaper (not shown) so that it is retained in the moulding 45 even though there is not applied a squeezing force on the moulding 45.

The invention is not limited to the embodiments shown and described in the Figures. Other embodiment with other cross-sectional shapes of recesses, types of grinding elements and other groove designs in the retainer means are possible within the scope of this invention and the matter specified in the claims.

The invention claimed is:

1. Cylindric drum with replaceable grinding elements, comprising a cylindric drum provided at its circumferential edge with a number of recesses that each are adapted for accommodating a replaceable grinding element including retainer means in which are mounted a sandpaper, support brushes and/or retainer brushes, the recesses in the cylindric drum are made with inner side walls, the retainer means are made with corresponding outer side walls, and a wedge action between the inner side walls of the recesses and the outer side walls of the retainer means causing a squeezing force on the outer side walls of the retainer means directed in a circumferential direction and occurs during use, wherein, the retainer means are designed with grooves for fastening at least one sandpaper, support brush and/or retainer brush, and the grooves extend from upper sides of the retainer means and into the retainer means for forming at least one elastic and pliable flap which is disposed between the grooves and at least one of the outer side walls of the retainer means.

2. Cylindric drum according to claim 1, wherein, the recesses have a radially outwards pointed cross-sectional shape.

3. Cylindric drum according to claim 1, wherein, the retainer means are shaped as mouldings, where each moulding is adapted for longitudinally displacing mounting in a recess.

4. Cylindric drum according to claim 3, wherein, the groove in the moulding is made up of plural sections comprising a first section.

5. Cylindric drum according to claim 3, wherein, the moulding is adapted for mounting in a recess with a spring plate situated in a bottom section of the recess, where the spring plate in an active position exerts a radially outwards directed pressure on the moulding, whereby a squeezing force arises on at least a section of the first section of the groove.

6. Cylindric drum according to claim 1, wherein, the recesses have a radially inwards tapering cross-sectional shape.

7. Cylindric drum according to claim 6, wherein, the retainer means are made as blocks, where each block is adapted for mounting in a recess that is designed as a hole at the circumferential edge of the cylindric drum, and that in each hole there is provided at least one retainer means that interacts releasably with at least one corresponding retainer means on at least one of the side walls of the blocks.

8. Cylindric drum according to claim 6, wherein, a lower section of each hole in the circumferential edge of the cylindric drum is connected with a channel which is preferably oriented in parallel with the axis of rotation of the cylindric drum.

9. Cylindric drum according to claim 6, wherein, the retainer means are designed as one or more of the following:

fluting/projection, cutout, locking groove/spring.

10. Cylindric drum according to claim 6, wherein, means for accommodating sandpaper and/or brushes have been provided on a block.

11. Cylindric drum according to claim 4, wherein the first section is a straight groove.

12. Cylindric drum according to claim 11, further comprising a second section.

13. Cylindric drum according to claim 12, wherein the second section includes a cavetto or a straight groove connected at an angle in relation to the first section of the groove of the moulding.

14. Cylindric drum with replaceable grinding elements, comprising a cylindric drum provided at its circumferential edge with a number of recesses that each are adapted for accommodating a replaceable grinding element including retainer means in which are mounted a sandpaper, support brushes and/or retainer brushes, the recesses in the cylindric drum are made with inner side walls, the retainer means are made with corresponding outer side walls, and a wedge action between the inner side walls of the recesses and the outer side walls of the retainer means causing a squeezing force on the outer side walls of the retainer means directed in a circumferential direction and occurs during use, wherein, the retainer means are designed with grooves for fastening at least one sandpaper, support brush and/or retainer brush, and the grooves extend from upper sides of the retainer means and into the retainer means for forming at least one elastic and pliable flap which is disposed between the grooves and at least one of the outer side walls of the retainer means, and the retainer means are entirely within the drum, with only the sandpaper, support brush and/or retainer brush extending out of the drum.

* * * * *